US007871146B2

(12) United States Patent
Koike et al.

(10) Patent No.: US 7,871,146 B2
(45) Date of Patent: Jan. 18, 2011

(54) PRINTING APPARATUS, RECORDING HEAD CLEANING METHOD, CONTROL PROCESS AND COMPUTERIZED CLEANING PROGRAM FOR THE RECORDING HEAD IN A PRINTER

(75) Inventors: Toshiaki Koike, Shiojiri (JP); Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 923 days.

(21) Appl. No.: 11/801,220

(22) Filed: May 9, 2007

(65) Prior Publication Data

US 2007/0206046 A1 Sep. 6, 2007

Related U.S. Application Data

(63) Continuation of application No. 11/050,223, filed on Feb. 2, 2005, now Pat. No. 7,232,204.

(30) Foreign Application Priority Data

Feb. 2, 2004 (JP) ..... 2004-025416

(51) Int. Cl.
*B41J 2/165* (2006.01)

(52) U.S. Cl. ..... 347/23; 347/22

(58) Field of Classification Search ..... 347/22–35
See application file for complete search history.

(56) References Cited

FOREIGN PATENT DOCUMENTS

| | | |
|---|---|---|
| EP | 0 525 988 A2 | 2/1993 |
| JP | 06-206320 | 7/1994 |
| JP | 2000-141686 | 5/2000 |
| JP | 2001-199057 | 7/2001 |
| JP | 2003-131859 | 5/2003 |
| JP | 2003-300313 | 10/2003 |

*Primary Examiner*—Shih-Wen Hsieh
(74) *Attorney, Agent, or Firm*—Michael T. Gabrik

(57) ABSTRACT

The cleaning process best suited to the condition of an inkjet printer is selected and run, thereby removing nozzle clogging without wastefully consuming ink. The first time a cleaning switch 7 is operated a CL1 cleaning process is run. If the cleaning switch 7 is pressed a second time and the print pass count is less than e.g., 400, a CL2 cleaning process that uses more ink than the CL1 process is used to clean the recording head, but if the print pass count is 400 or more, the CL1 cleaning process is used. If the print pass count is less than 400 the third time the switch is operated, the CL2 cleaning process is used, but the CL1 cleaning process is used if the print pass count is 400 or more. If the cleaning switch 7 is operated four or more times and the print pass count is less than 400, a YCL cleaning process that consumes substantially no ink is used to clean the recording head, but if the print pass count is 400 or more, the CL1 cleaning process is used.

7 Claims, 4 Drawing Sheets

Cleaning conditions management table

| Selection conditions | | Selected cleaning level |
|---|---|---|
| Cleaning switch operation count | Print pass count since previous cleaning | Cleaning level name |
| 1 | - | CL1 |
| 2 | PC < 400 | CL1 |
| | PC ≥ 400 | CL2 |
| 3 | PC < 400 | CL1 |
| | PC ≥ 400 | CL2 |
| 4 or more | PC < 400 | CL1 |
| | PC ≥ 400 | YCL |

Cleaning conditions management table

| Selection conditions | | Selected cleaning level |
|---|---|---|
| Cleaning switch operation count | Print pass count since previous cleaning | Cleaning level name |
| 1 | • | CL1 |
| 2 | PC • 400 | CL1 |
| | PC • 400 | CL2 |
| 3 | PC • 400 | CL1 |
| | PC • 400 | CL2 |
| 4 or more | PC • 400 | CL1 |
| | PC • 400 | YCL |

PRINTING APPARATUS, RECORDING HEAD CLEANING METHOD, CONTROL PROCESS AND COMPUTERIZED CLEANING PROGRAM FOR THE RECORDING HEAD IN A PRINTER

The present invention is a continuation application of U.S. Ser. No. 11/050,223 which was filed on Feb. 2, 2005 now U.S. Pat. No. 7,232,204 and which was allowed on Feb. 9, 2007, and relates to an inkjet printing apparatus, recording head cleaning method, control process and computerized cleaning program for the recording head in a printer.

BACKGROUND OF THE INVENTION

Description of Related Art

Inkjet printers that print by discharging ink from a recording head are widely available. This type of printer requires regular maintenance in order to maintain the reliability of the recording head. To prevent nozzle clogging and other printing problems resulting from ink drying and ink viscosity increasing inside the recording head nozzles, inkjet printers often have a mechanism for regularly cleaning the nozzles as shown in, for example, Japanese Unexamined Patent Appl. Pub. 2000-141686 (page 9 and FIG. 11).

Cleaning the recording head in a conventional inkjet printer is not limited to simply cleaning the nozzle port (by wiping or rubbing), and is more specifically directed to forcibly discharging ink that has increased in viscosity inside the nozzles, and to clearing bubbles that have grown in the ink path from the ink tank to the nozzles. In the cleaning process ink is vacuumed from the recording head. The cleaning operation consumes much ink, thus actually reducing the amount of usable ink inside the cartridge, increasing the frequency of cartridge replacement, and thus increasing the operating cost. The number of depleted cartridges (waste) thus increases, which is undesirable in terms of resource conservation and environmental protection.

The cleaning method taught in Japanese Unexamined Patent Appl. Pub. 2000-141686 provides timer cleaning for repeatedly cleaning the recording head at a regular interval in addition to manual cleaning which consumes a relatively large volume of ink and is used when the appropriate operator instruction is received. The cleaning method simply prevents manual cleaning from being used when the remaining ink level drops to a certain level. More particularly, this cleaning method does nothing to reduce ink consumption due to cleaning. More specifically, timer cleaning and manual cleaning simply consume different amounts of ink, and in neither cleaning mode is ink consumption reduced by adapting the cleaning process to the current condition of the printer.

SUMMARY OF THE INVENTION

According to the present invention an optimal cleaning process is selected from among a plurality of cleaning processes wherein each selected cleaning process consumes a different amount of ink based on the number of times a start cleaning command is asserted and the scan count of the recording head Preferably, the scan count in the recording head cleaning method of the present invention is compared with at least one threshold value.

The recording head cleaning method involves executing a normal cleaning process that vacuums a normal volume of ink from inside the recording head if a start cleaning command is asserted and the start cleaning command assertion count is one; executing the normal cleaning process if the start cleaning command assertion count is two or more and less than a specified value, and the recording head scan count is greater than or equal to a specified threshold value, executing a strong cleaning process that consumes more ink than the normal cleaning process if the recording head scan count is less than said threshold value; and executing a dummy cleaning process that consumes substantially no ink when the start cleaning command assertion count is greater than or equal to said specified value and the recording head scan count is less than said threshold value, but executing the normal cleaning process if the recording head scan count is greater than or equal to the specified threshold value.

The printing apparatus of the present invention includes a recording head for discharging ink, and comprises: cleaning means for cleaning the recording head by vacuuming ink from inside the recording head in response to a start cleaning command; a cleaning command means for asserting said start cleaning command; a scan count counting means for counting the scan count of the recording head following each start cleaning command; a start cleaning command assertion count counting means for counting the number of times the start cleaning command was asserted by the cleaning command means; and selection means for consecutively selecting a cleaning process to be used by the cleaning means from among a plurality of cleaning processes, each consuming a different ink volume, based on the count computation of the scan count counting means and the count computation of the start cleaning command assertion counting means following each recording head cleaning operation.

Preferably, the cleaning means of the printing apparatus executes a normal cleaning process that vacuums a normal volume of ink from inside the recording head if the start cleaning command assertion count is one; executes the normal cleaning process if the start cleaning command assertion count is two or more and less than a specified value and the recording head scan count is greater than or equal to a specified threshold value, but executes a strong cleaning process that consumes more ink than the normal cleaning process if the recording head scan count is less than said threshold value; and executes a dummy cleaning process that consumes substantially no ink when the start cleaning command assertion count is greater than or equal to said specified value and the recording head scan count is less than said threshold value, but executes the normal cleaning process if the recording head scan count is greater than or equal to the specified threshold value.

Another aspect of the present invention is a computerized cleaning program for cleaning a recording head in a printing apparatus in which the recording head discharges ink comprising the steps of: selecting an optimal cleaning process from among a plurality of cleaning processes, each consuming a different ink volume, based on a computation of the number of times a start cleaning command is asserted and a computation of the scan count of the recording head following the last assertion of the start cleaning command, and cleaning the recording head according to the selected cleaning process.

Yet another aspect of the present invention is a control process for cleaning the recording head of a printer in which the recording head discharges ink by vacuuming ink from inside the recording head with the recording head or printer having a switch for starting each recording head cleaning operation and counter means for counting the number of times the switch is operated and for counting the scan count of the recording head in the printer comprising the steps of recording the cleaning switch operation count; recording the recording head scan count; referencing a cleaning conditions management table containing a column denoting how many times the cleaning switch was operated for comparison with different conditions of recording head scan counts according to specific threshold values at specific cleaning switch operation counts, for selecting different cleaning levels according to the cleaning switch operation count and recording head scan count in the cleaning conditions management table; wherein a first cleaning step is selected representing a normal cleaning process that vacuums a normal volume of ink from inside the recording head if the cleaning switch operation count is one; wherein another normal cleaning process is selected if the cleaning switch operation count is two or more and less than a specified value, and the recording head scan count is greater than or equal to a specified threshold value, wherein a strong cleaning process is selected that consumes more ink than the normal cleaning process in the first cleaning step if the recording head scan count is less than said threshold value; selecting a cleaning process designated "dummy cleaning process" that consumes substantially no ink when the cleaning switch operation count is greater than or equal to said specified value and the recording head scan count is less than said threshold value, and selecting the normal cleaning process if the recording head scan count is greater than or equal to the specified threshold value.

ADVANTAGES OF THE INVENTION

By selecting and applying the cleaning process that is optimal for the printer conditions based on the number of times the start cleaning command is output and the recording head scan count, nozzle clogging can be effectively corrected without wastefully consuming ink. Furthermore, thus reducing ink consumption also reduces the frequency at which ink cartridges need replacing due to ink depletion, thereby contributing to resource conservation and environmental protection.

Furthermore, because the cleaning switch operation count and the recording head scan count are read from respective counters and a cleaning conditions management table is referenced to select the appropriate cleaning process when the cleaning switch is operated, nozzle clogging can be effectively corrected without wastefully consuming ink. Furthermore, thus reducing ink consumption also reduces the frequency at which ink cartridges need replacing due to ink depletion, thereby contributing to resource conservation and environmental protection.

Other advantages and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

Figure 2:
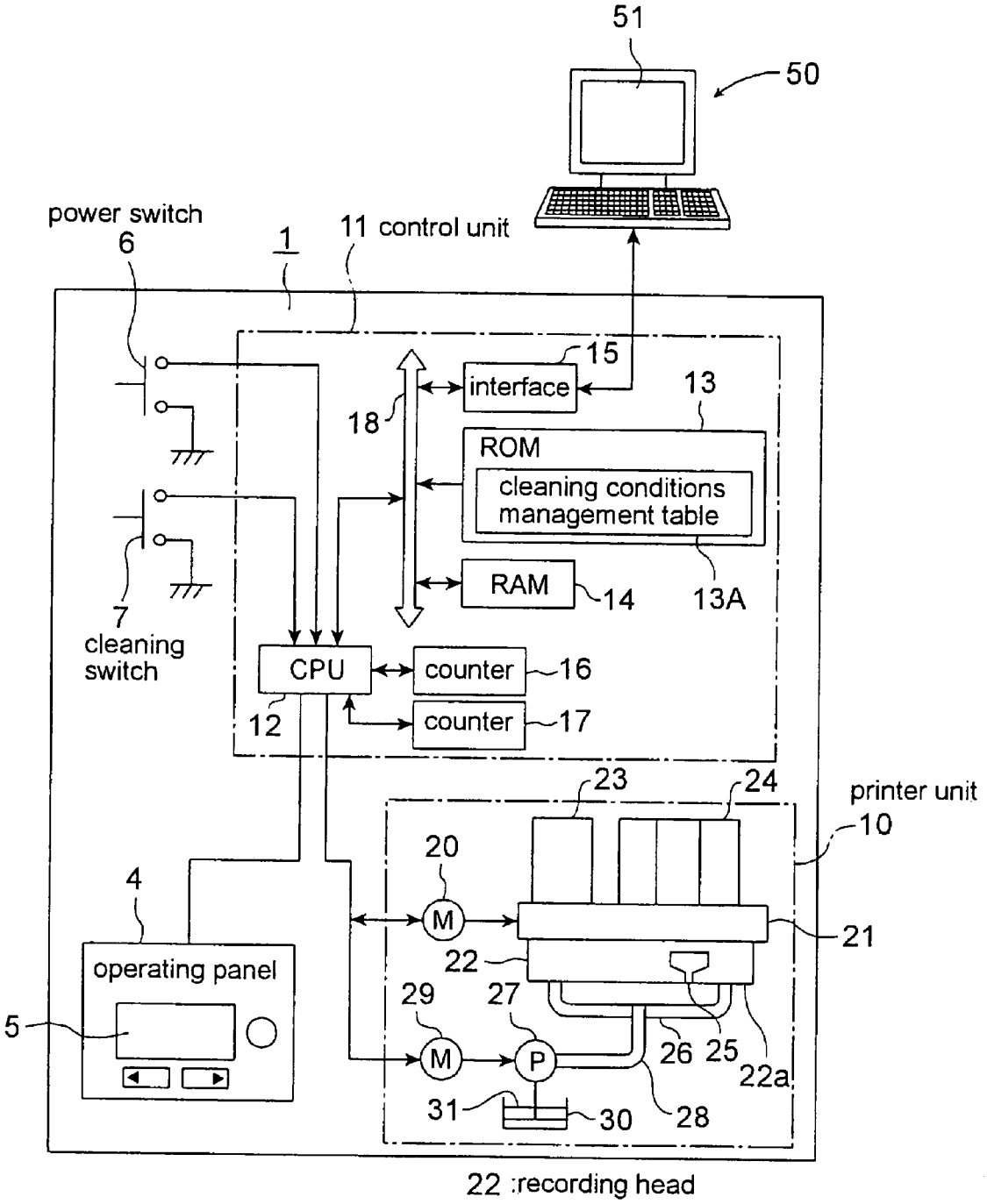
FIG. 2 is a block diagram showing the arrangement of the printing apparatus shown in FIG. 1.

A printing apparatus 1 according to this first embodiment of the invention prints in the same way as a conventional printer, that is, based on print data sent from a host computer 50 (see FIG. 2). The printed paper 40 is discharged from the paper exit 3 and deposited on a tray 2.

An operating panel 4 is located at the front of the printing apparatus 1. An LCD (liquid crystal display) 5, power switch 6, and cleaning switch 7 are provided on the operating panel 4. Operating menus for controlling the printing apparatus 1, operating content, the operating status, and error messages are presented on the LCD 5. The power switch 6 is pressed to supply power to the printing apparatus 1, and the cleaning switch 7 is pressed to force a manual cleaning operation as further described below.

Figure 1:
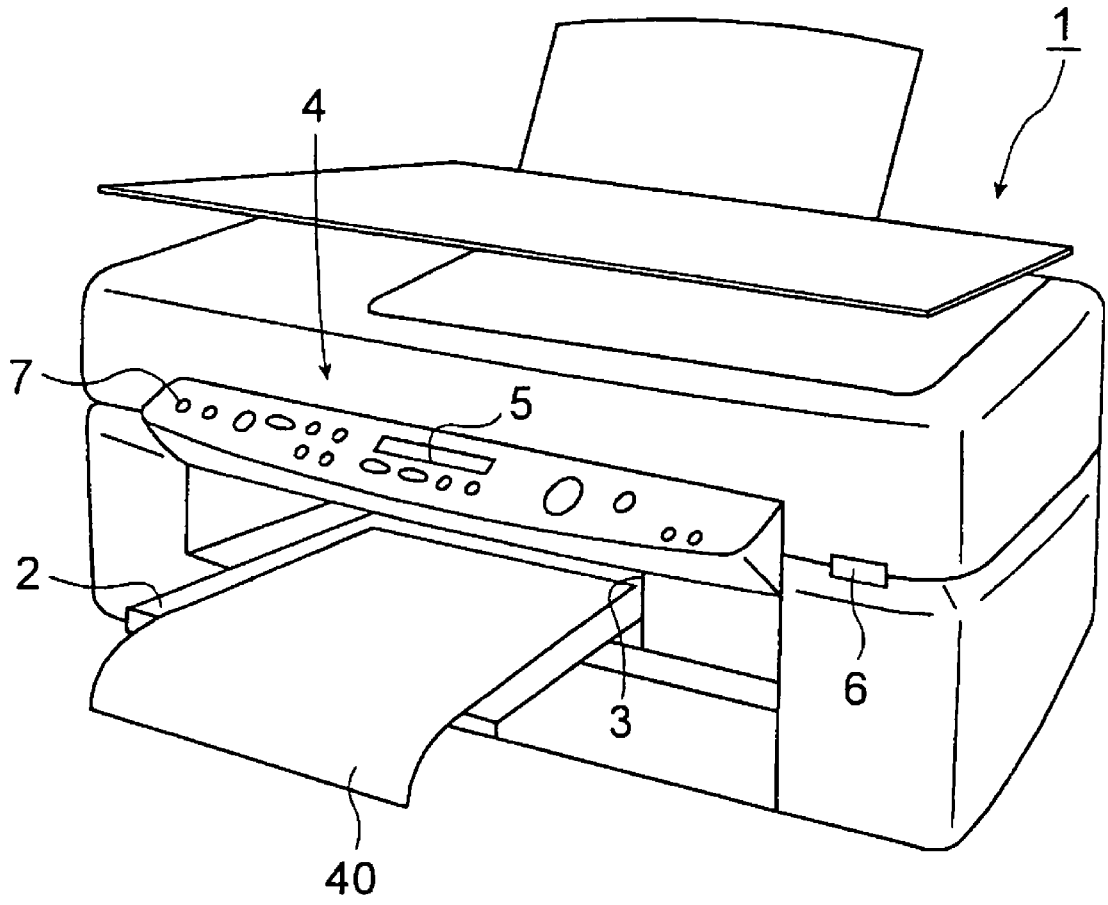
FIG. 1 is an oblique view of a printing apparatus according to a preferred embodiment of the invention.

As shown in FIG. 2, the printing apparatus 1 has a printer unit 10 for printing to paper 40 (see FIG. 1), and a control unit 11 for controlling the printer unit 10.

The control unit 11 has a CPU 12, ROM 13, RAM 14, interface 15, and two counters 16 and 17. The CPU 12 is connected to the interface 15 over a bus 18. The interface 15 is in turn connected to the host computer 50 via a cable not shown. The CPU 12 controls the printer unit 10 according to a program stored in ROM 13. To print, the CPU 12 drives the printer unit 10 based on the print data sent from the host computer 50 and received through the interface 15 to print on paper 40.

The first counter 16 counts the number of print passes, which corresponds to the number of times the printer recording head 22 (further described below) traverses the paper 40 (referred to herein as the scan count). The counter 16 thus increments each time the recording head 22 scans the paper 40. The other counter 17 counts the number of times the cleaning switch 7 is depressed to initiate the cleaning operation, and increments each time the cleaning switch 7 is pressed. Counter 16 is thus called the print pass counter and counter 17 is called the switch operation counter below. In addition, the current count of the print pass counter 16 is called the print pass count PC, and the current count of the switch operation counter 17 is called the switch count BTN.

The printer unit 10 has a carriage motor 20 and a carriage 21 that is moved bidirectionally in a main scanning direction (perpendicularly to the direction in which the paper 40 travels) by the carriage motor 20. The recording head 22 is disposed on the bottom of this carriage 21, and ink cartridges 23, 24 (two types, black and color) for supplying ink to the recording head 22 are removably installed on the top of the carriage 21.

A cap 26 for capping the nozzles 25 of the recording head 22 is disposed at the home position at one end in the direction of carriage 21 movement. A suction pump 27 for creating negative pressure inside the cap 26 when the nozzles 25 are capped by the cap 26 is connected through a pump tube 28 to the cap 26. The suction pump 27 is driven by a motor 29, and ink vacuumed from the ink cartridge by the suction pump 27 is absorbed by a liquid absorbent material 31 inside a waste tray 30.

The printing apparatus 1 runs a cleaning process from time to time to prevent a deterioration in print quality. This cleaning process forcibly suctions ink from inside the nozzles 25 as a result of the suction pump 27 creating negative pressure inside the cap 26 when the nozzles 25 are capped, and wipes the nozzle plate 22*a* with a wiping member not shown after ink suctioning is completed. This cleaning process eliminates clogging inside the nozzles 25 of the recording head 22, as well as bubbles inside the ink path communicating with the nozzles 25.

This cleaning process is executed automatically when the printing apparatus 1 resumes printing after a prolonged period of not printing, that is, if a specified period of time (two or three days, for example) or longer has passed since the last (previous) cleaning process when the power is turned on. The cleaning process is also executed when forced by pressing the cleaning switch 7 on the operating panel 4 or selecting a corresponding cleaning button presented on the screen 51 of the host computer 50. More specifically, the CPU 12 similarly drives the motors 20 and 29 to execute the cleaning process whenever cleaning is required as indicated by operation of the cleaning switch 7, the power switch 6, the host computer 50, or other means. The content of the cleaning process, however, depends upon the condition of the printing apparatus 1. More specifically, a plurality of cleaning modes are defined according to the printer condition.

Figures 3, 4:
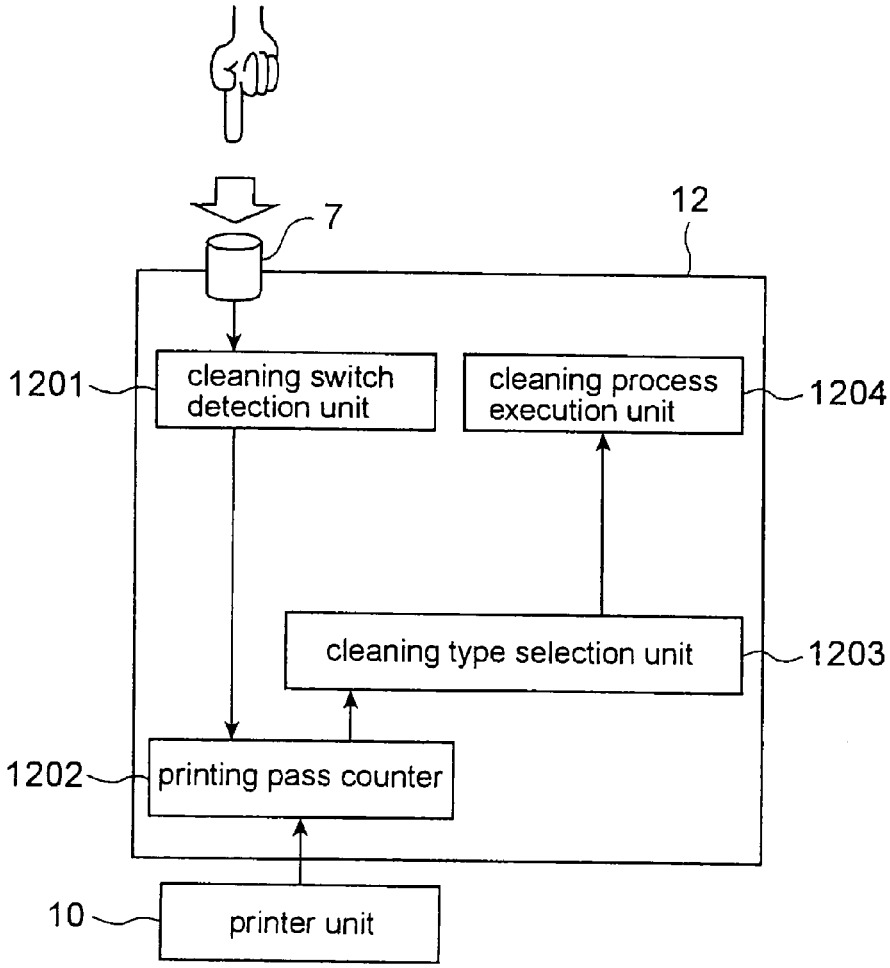
FIG. 3 shows a sample cleaning conditions management table stored nozzle the printing apparatus shown in FIG. 1.
FIG. 4 is a block diagram of the cleaning process in the printing apparatus shown in FIG. 1.

FIG. 3 is a cleaning conditions table showing the relationship between the number of times the cleaning switch 7 is operated (pressed), the print pass count since the last cleaning operation, and the cleaning mode (CL1, CL2, YCL) that is selected and used.

The print pass count PC since the previous cleaning operation is the difference between the print pass count when the cleaning process was last executed and the print pass count when the cleaning switch 7 was currently pressed to clean the recording head.

Cleaning level CL1 is the normal cleaning process in which the normal ink volume is suctioned from inside the recording head. Cleaning level CL2 is a strong cleaning process that consumes more ink than cleaning level CL1. Cleaning level YCL first flushes the recording head, then cleans the recording head surface, caps the head, and then suctions the nozzles. Cleaning level YCL consumes substantially no ink.

A printing apparatus 1 according to this embodiment of the invention thus executes the cleaning process on one of three cleaning levels, each of which consumes a different amount of ink, that is, cleaning level CL1, cleaning level CL2, and a dummy cleaning level YCL. The ink volume consumed at these different cleaning levels increases in the order YCL, CL1, CL2. As noted above, the dummy cleaning level YCL consumes substantially no ink. Cleaning levels CL1 and CL2 each involve vacuuming ink from the nozzles in order to remove ink that has increased in viscosity and remove bubbles inside the ink path, wiping the recording head surface with a rubber squeegee to clean the nozzle plate, and rubbing the recording head surface with a sponge as needed.

Returning to FIG. 2, a cleaning conditions management table 13A compiling the foregoing cleaning conditions table in a data table is stored in ROM 13. This cleaning conditions management table 13A thus stores the number of times the cleaning switch 7 was operated, the print pass count since the previous cleaning operation, and data correlating the cleaning level (mode) to these counts. The CPU 12 references the cleaning conditions management table 13A based on the print pass count and the number of times the cleaning switch 7 is operated to determine what cleaning process to apply.

The CPU 12 thus manages operation of the cleaning switch 7 and power switch 6, manages the print pass count since the previous cleaning operation, and determines the type of cleaning process to run when cleaning conditions are met. After determining the type of cleaning process, the CPU 12 references the cleaning conditions management table 13A and selects the cleaning level.

More specifically, using the cleaning conditions management table 13A shown in FIG. 2, cleaning at cleaning level CL1 is used the first time the cleaning switch 7 is pressed after the printing apparatus 1 is used for the first time or the printer is reset. If the cleaning switch 7 is pressed again, that is, a second time, the cleaning process is determined according to the print pass count. More specifically, if the print pass count is 400 or more the second time the cleaning switch 7 is pressed, cleaning level CL1 is applied, but if the print pass count is less than 400 passes, cleaning level CL2 is used.

The third time the cleaning switch 7 is operated, the cleaning process is likewise determined according to the print pass count. More specifically, if the print pass count is 400 or more the third time the cleaning switch 7 is pressed, cleaning level CL1 is applied, but if the print pass count is less than 400 passes, cleaning level CL2 is used.

The fourth and subsequent times the cleaning switch 7 is operated, the cleaning process is again determined according to the print pass count. More specifically, if the print pass count is 400 or more the fourth or later time the cleaning switch 7 is pressed, cleaning level CL1 is applied, but if the print pass count is less than 400 passes, cleaning level YCL is used.

This threshold value of 400 is set based on the number of print passes required to print approximately two A4-size pages. This is to prevent the cleaning level from dropping from CL2 to CL1 even if test printing to confirm the condition of the ink prints two or more pages. Test printing is normally used when ink clogs cannot be removed. Note, further, that this threshold value can be appropriately set and shall not be limited to 400.

The first time the cleaning switch 7 is operated, the normal cleaning process is thus applied at cleaning level CL1. If the cleaning switch 7 is operated a second or third time, the normal cleaning process at cleaning level CL1 is applied if the print pass count since the last time the cleaning switch 7 was operated is 400 or more, but if the print pass count is less than 400, the cleaning process is run at cleaning level CL2, which is a stronger cleaning process than CL1. If the cleaning switch 7 is pressed four or more times, the normal cleaning process at cleaning level CL1 is applied if the print pass count since the last cleaning operation is 400 or more, but if the print pass count is less than 400, cleaning level YCL is used, thus consuming substantially no ink.

FIG. 4 is a function block diagram of the cleaning process run by the CPU 12 of this printing apparatus 1. The CPU 12 implements a cleaning switch detection unit 1201, a print pass counter 1202, a cleaning type selection unit 1203, and a cleaning process execution unit 1204. The cleaning switch detection unit 1201 detects operation of the cleaning switch 7.

The print pass counter 1202 monitors the scan count of the recording head 22 from the first time printing apparatus 1 power is turned on. When the cleaning switch 7 is pressed, the print pass counter 1202 outputs the value of the scan count at that time, then resets, and resumes counting the scan count. As a result, the first time the cleaning switch 7 is pressed, the cumulative scan count to that time is output, but the second and subsequent times the cleaning switch 7 is pressed, the print pass counter 1202 outputs the scan count since the last time the scan count was output.

The cleaning type selection unit 1203 selects the cleaning level (mode) based on the number of times the cleaning switch 7 has been operated and the print pass count (scan count).

The cleaning process execution unit 1204 then cleans the recording head 22 at the cleaning level selected by the cleaning type selection unit 1203.

Figure 5:
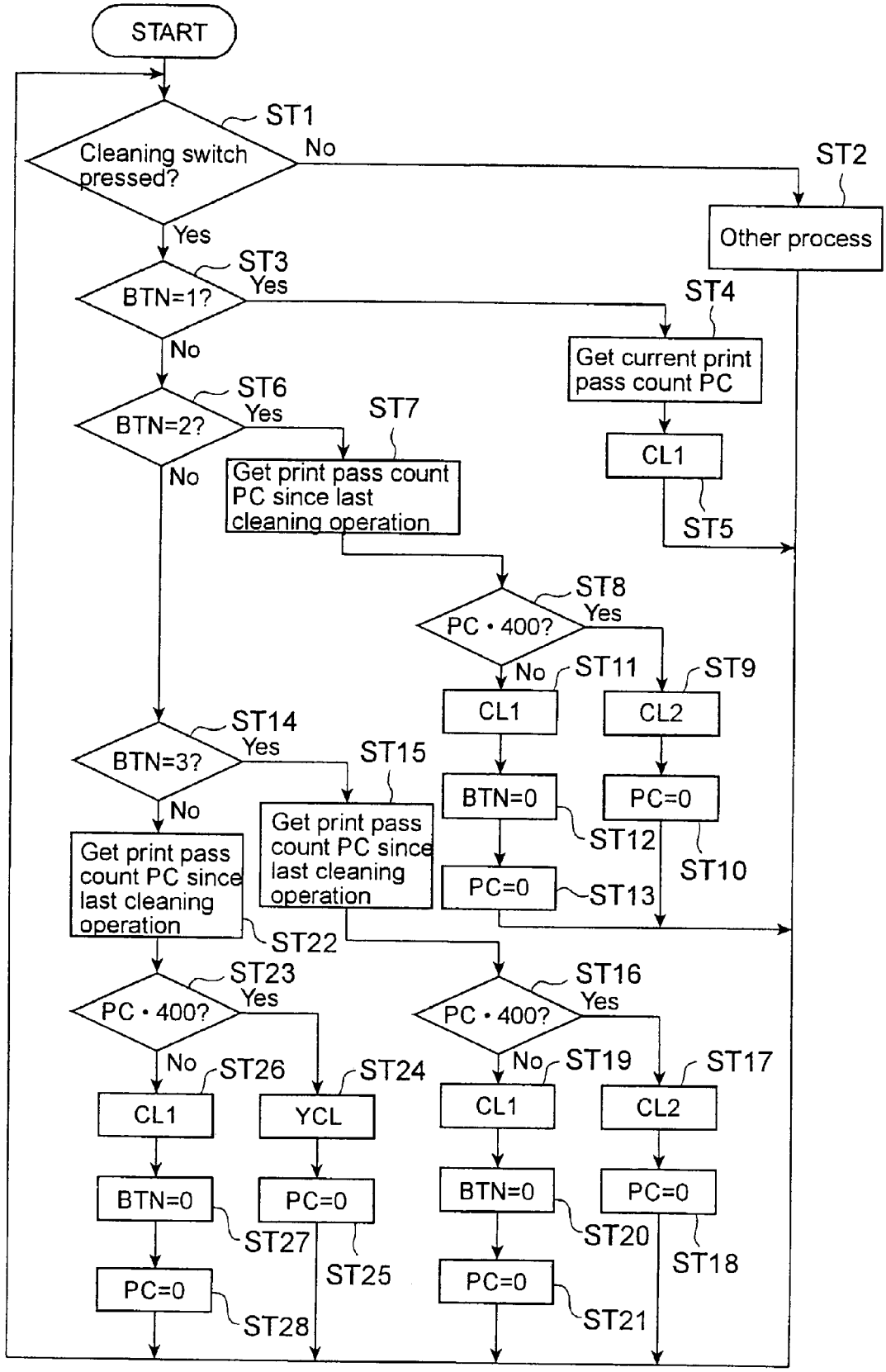
FIG. 5 is a flow chart of the cleaning process in the printing apparatus shown in FIG. 1.

The cleaning process of a printing apparatus 1 according to this embodiment of the invention is described next with reference to the flow chart shown in FIG. 5. This description assumes that the cleaning switch 7 was never previously operated.

Whether the cleaning switch 7 was pressed is determined first (step ST1). If the cleaning switch 7 was not pressed (step ST1 returns no), another process is run (step ST2).

If the cleaning switch 7 was pressed, the switch count BTN denoting the number of times the cleaning switch 7 has been operated is incremented 1, and whether BTN=1, that is, whether this is the first time the cleaning switch 7 is operated, is determined (step ST3). If the cleaning switch 7 is operated for the first time and BTN=1, the current print pass count PC is read from the print pass counter 16 (step ST4). The recording head is then cleaned at cleaning level CL1 (step ST5). The recording head is thus cleaned at a cleaning level consuming the normal ink volume the first time the cleaning switch 7 is operated (that is, when BTN=1).

The next time the cleaning switch 7 is operated, step ST1 again increments the switch operation counter 17 by 1, and step ST3 executes. Because BTN=2 this time, however, step ST3 returns no and step ST6 determines if BTN=2. Because BTN=2, the print pass count PC since the previous cleaning operation (the first cleaning operation) is acquired (step ST7).

After acquiring the print pass count PC since the previous (first) cleaning operation, whether PC is less than 400 is determined (step ST8). If print pass count PC is less than 400 (step ST8 returns yes), cleaning proceeds at cleaning level CL2 (step ST9). Thus, if the cleaning switch 7 is pressed again within a short time after the first time the cleaning process is run (such as when the first cleaning process did not sufficiently remove any nozzle clogging), cleaning is repeated using a cleaning level that consumes more ink than the first cleaning operation. After cleaning is completed in step ST9, the print pass count PC is cleared (step ST10), and control loops back to step ST1.

However, if step ST8 determines that the print pass count PC since the previous cleaning operation is 400 or more (step ST8 returns no), cleaning proceeds at cleaning level CL1 (step ST11). Thus, if the cleaning switch 7 is operated a longer period of time after the first cleaning operation (such as when the first cleaning process sufficiently removed any clogging), cleaning proceeds at the same level used in the first cleaning operation. After this cleaning operation ends, the switch count BTN is cleared (step ST12), the print pass count PC is cleared (step ST13), and control loops back to step ST1.

The next time the cleaning switch 7 is operated, step ST1 again increments the switch operation counter 17 by 1, and step ST3 executes. Because BTN=3 this time, however, step ST3 returns no and step ST6 executes. However, because BTN=3, step ST6 also returns no, and step ST14 executes to determine if BTN=3. Because BTN=3, the print pass count PC since the previous cleaning operation (the second cleaning operation) is acquired (step ST15).

After acquiring the print pass count PC since the previous (second) cleaning operation, whether PC is less than 400 is determined (step ST16). If print pass count PC is less than 400 (step ST16 returns yes), cleaning proceeds at cleaning level CL2 (step ST17). Thus, if the cleaning switch 7 is pressed again within a short time after the second time the cleaning process is run (such as when the second cleaning process did not sufficiently remove any nozzle clogging), cleaning is repeated at cleaning level CL2. After cleaning is completed in step ST17, the print pass count PC is cleared (step ST18), and control loops back to step ST1.

However, if step ST16 determines that the print pass count PC since the previous cleaning operation is 400 or more (step ST16 returns no), cleaning proceeds at cleaning level CL1 (step ST19). Thus, if the cleaning switch 7 is operated a longer period of time after the second cleaning operation (such as when the second cleaning process sufficiently removed any clogging), cleaning proceeds at the same level used in the first cleaning operation. After this cleaning operation ends, the switch count BTN is cleared (step ST20), the print pass count PC is cleared (step ST21), and control loops back to step ST1.

The next time the cleaning switch 7 is operated, step ST1 again increments the switch operation counter 17 by 1, and step ST3 executes. Because BTN=4 this time, however, step ST3 returns no and step ST6 executes. However, because BTN=4, both step ST6 and step ST14 also return no, and step S22 executes to acquire the print pass count PC since the last (i.e., third) cleaning process.

After acquiring the print pass count PC since the previous (third) cleaning operation, whether PC is less than 400 is determined (step ST23). If print pass count PC is less than 400 (step ST23 returns yes), cleaning proceeds at cleaning level YCL (step ST24): Thus, if the cleaning switch 7 is pressed again within a short time after the third time the cleaning process is run (such as when the third cleaning process did not sufficiently remove any nozzle clogging), cleaning is repeated at a cleaning level YCL that consumes substantially no ink. This includes flushing, wiping the recording head surface, capping the head, and then vacuuming without suctioning ink. After YCL level cleaning is completed in step ST24, the print pass count PC is cleared (step ST25), and control loops back to step ST1.

However, if step ST23 determines that the print pass count PC since the previous cleaning operation is 400 or more (step ST23 returns no), cleaning proceeds at cleaning level CL1 (step ST26). Thus, if the cleaning switch 7 is operated a longer period of time after the third cleaning operation, cleaning proceeds at the same level used in the first cleaning operation. After this cleaning operation ends, the switch count BTN is cleared (step ST27), the print pass count PC is cleared (step ST28), and control loops back to step ST1. The same operation executed the fourth time the cleaning switch 7 is pressed applies the fifth and subsequent times the cleaning switch 7 is operated.

A printing apparatus 1 according to this embodiment of the present invention thus runs a normal cleaning process at cleaning level CL1 the first time a cleaning switch 7 is operated.

If the cleaning switch 7 is operated a second time and the print pass count PC since the first cleaning process is less than 400, this printing apparatus 1 cleans the recording head at cleaning level CL2, which is stronger (that is, consumes more ink) than CL1. However, if the cleaning switch 7 is operated a second time and the print pass count is greater than or equal to 400, this printing apparatus 1 cleans the recording head at the normal cleaning level CL1.

If the cleaning switch 7 is operated a third time and the print pass count PC since the second cleaning process is less than 400, this printing apparatus 1 cleans the recording head at the stronger cleaning level CL2, but cleans the recording head at the normal cleaning level CL1 if the print pass count is greater than or equal to 400.

If the cleaning switch 7 is operated four or more times and the print pass count PC since the previous cleaning process is less than 400, this printing apparatus 1 cleans the recording head at cleaning level YCL, but cleans the recording head at the normal cleaning level CL1 if the print pass count is greater than or equal to 400.

A printing apparatus 1 according to the present invention thus provides three cleaning levels CL1, CL2, and YCL that each consume a different amount of ink, selects the best cleaning level according to the condition of the printing apparatus 1, and cleans the recording head 22 at the selected cleaning level. Nozzle clogging can thus be eliminated without wastefully consuming ink.

Furthermore, thus reducing ink consumption also reduces the frequency at which ink cartridges need replacing due to ink depletion, thereby contributing to resource conservation and environmental protection.

It will be obvious to one with ordinary skill in the related art that while three cleaning levels CL1, CL2, and YCL are described in the foregoing embodiment, the invention shall not be so limited and more cleaning levels could be provided.

Furthermore, while 400 is the threshold value used in the foregoing embodiments to determine which cleaning level to use, the invention shall not be so limited and a different value could be used. More specifically, this value can be set as desired according to the condition of the printing apparatus 1.

Yet further, a means of setting this threshold value could also be provided. Yet further, multiple threshold values could be set and compared with the print pass count PC to select the appropriate cleaning process for a wider range of situations.

The present invention has also been described using a desktop printer by way of example as the printing apparatus 1, but the invention can be applied to any type of inkjet printer. For example, the present invention could also be applied in a fax machine that uses inkjet printing.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A method for cleaning an ink-discharging recording head, comprising the steps of:

selecting a cleaning process from among a plurality of cleaning processes, each consuming a different ink volume, based on a computation of a number of times that a start cleaning command has been asserted during a specific time period and a computation of a scan count of the recording head; and cleaning the recording head according to the selected cleaning process;

wherein the scan count computation is computed during a period from after the last cleaning process was completed to assertion of a current start cleaning command.

2. A method for cleaning an ink-discharging recording head as described in claim 1, wherein a first cleaning process is selected when (i) the start cleaning assertion command count is one, or (ii) the start cleaning command count is two or more but less than a first specified value greater than two and the recording head scan count is greater than or equal to a threshold scan count;

a second cleaning process, that consumes more ink than the first cleaning process, is selected when (i) the start cleaning assertion command count is two or more but less than a second specified value greater than two and the recording head scan count is less than the threshold scan count; and a third cleaning process, that consumes less ink than the first cleaning process, is selected when the start cleaning assertion command count is greater than or equal to the second specified value but less than the first specified value and the recording head scan count is less than the threshold scan count.

3. A printing apparatus having a recording head that discharges ink, comprising:

a cleaning process execution unit configured to clean the recording head by vacuuming ink from inside the recording head in response to a start cleaning command;

an input element adapted to be activated to assert a start cleaning command;

a recording head scan counter;

a start cleaning command assertion counter; and a selection unit configured to select, from among a plurality of cleaning processes, a cleaning process to be executed by the cleaning process execution unit each time a start cleaning command is asserted, based on the count of recording head scan counter and the count of the start cleaning command assertion counter, each of the plurality of cleaning processes consuming a different volume of ink.

4. A printing apparatus as described in claim 3, wherein the count of the recording head scan counter is during a period from after the cleaning process execution unit last cleaned the recording head to the assertion of a present start cleaning command.

5. A printing apparatus as described in claim 3, wherein the selection unit is configured to select:

a first cleaning process when (i) the start cleaning assertion command count is one, or (ii) the start cleaning command count is two or more but less than a first specified value greater than two and the recording head scan count is greater than or equal to a threshold scan count;

a second cleaning process, that consumes more ink than the first cleaning process, when (i) the start cleaning assertion command count is two or more but less than a second specified value greater than two and the recording head scan count is less than the threshold scan count; and a third cleaning process, that consumes less ink than the first cleaning process, when the start cleaning assertion command count is greater than or equal to the second specified value but less than the first specified value and the recording head scan count is less than the threshold scan count.

6. A medium embodying a program for cleaning an ink-discharging recording head, the program comprising:

instructions for selecting a cleaning process from among a plurality of cleaning processes, each consuming a different ink volume, based on a computation of a number of times that a start cleaning command has been asserted during a specific time period and a computation of a scan count of the recording head;

instructions for cleaning the recording head according to the selected cleaning process; and instructions for computing the scan count during a period from after the last cleaning process was completed to assertion of a current start cleaning command.

7. A medium as described in claim 6, further comprising instructions for:

selecting a first cleaning process when (i) the start cleaning assertion command count is one, or (ii) the start cleaning command count is two or more but less than a first specified value greater than two and the recording head scan count is greater than or equal to a threshold scan count;

selecting a second cleaning process, that consumes more ink than the first cleaning process, when (i) the start cleaning assertion command count is two or more but less than a second specified value greater than two and the recording head scan count is less than the threshold scan count; and selecting a third cleaning process, that consumes less ink than the first cleaning process, when the start cleaning assertion command count is greater than or equal to the second specified value but less than the first specified value and the recording head scan count is less than the threshold scan count.

* * * * *